US008558786B2

(12) United States Patent
Lin

(10) Patent No.: US 8,558,786 B2
(45) Date of Patent: Oct. 15, 2013

(54) DRIVING METHODS FOR ELECTROPHORETIC DISPLAYS

(75) Inventor: Craig Lin, San Jose, CA (US)

(73) Assignee: SiPix Imaging, Inc., Fremont, CA (US)

( * ) Notice: Subject to any disclaimer, the term of this patent is extended or adjusted under 35 U.S.C. 154(b) by 129 days.

(21) Appl. No.: 13/009,711

(22) Filed: Jan. 19, 2011

(65) Prior Publication Data

US 2011/0175945 A1 Jul. 21, 2011

Related U.S. Application Data

(60) Provisional application No. 61/296,832, filed on Jan. 20, 2010.

(51) Int. Cl.
*G09G 3/34* (2006.01)

(52) U.S. Cl.
USPC ..... 345/107; 345/690; 345/204

(58) Field of Classification Search
USPC ..... 345/690
See application file for complete search history.

(56) References Cited

U.S. PATENT DOCUMENTS

| | | | |
|---|---|---|---|
| 4,143,947 | A | 3/1979 | Aftergut et al. |
| 4,443,108 | A | 4/1984 | Webster |
| 5,266,937 | A | 11/1993 | DiSanto et al. |
| 5,754,584 | A | 5/1998 | Durrant et al. |
| 5,831,697 | A | 11/1998 | Evanicky et al. |
| 5,923,315 | A | 7/1999 | Ueda et al. |
| 6,005,890 | A | 12/1999 | Clow et al. |
| 6,045,756 | A | 4/2000 | Carr et al. |
| 6,069,971 | A | 5/2000 | Kanno et al. |
| 6,111,248 | A | 8/2000 | Melendez et al. |
| 6,154,309 | A | 11/2000 | Otani et al. |
| 6,532,008 | B1 | 3/2003 | Guranlnick |
| 6,639,580 | B1 | 10/2003 | Kishi et al. |
| 6,657,612 | B2 | 12/2003 | Machida et al. |
| 6,671,081 | B2 | 12/2003 | Kawai |
| 6,674,561 | B2 | 1/2004 | Ohnishi et al. |
| 6,686,953 | B1 | 2/2004 | Holmes |
| 6,796,698 | B2 | 9/2004 | Sommers et al. |
| 6,903,716 | B2 | 6/2005 | Kawabe et al. |
| 6,914,713 | B2 | 7/2005 | Chung et al. |
| 6,995,550 | B2 | 2/2006 | Jacobson et al. |
| 7,177,066 | B2 | 2/2007 | Chung et al. |
| 7,242,514 | B2 | 7/2007 | Chung et al. |
| 7,283,119 | B2 | 10/2007 | Kishi |

(Continued)

FOREIGN PATENT DOCUMENTS

| | | |
|---|---|---|
| WO | WO 2005/004099 | 1/2005 |
| WO | WO 2005/031688 | 4/2005 |

(Continued)

OTHER PUBLICATIONS

U.S. Appl. No. 12/046,197, filed Mar. 11, 2008, Wang et al.

(Continued)

*Primary Examiner* — Quan-Zhen Wang
*Assistant Examiner* — David Lee
(74) *Attorney, Agent, or Firm* — Perkins Coie LLP

(57) ABSTRACT

The driving system and methods of the present invention enable interruption of updating images. The system and methods not only have the advantage that they can prevent overdriving of an electrophoretic display, but they also allow updating images in the highest speed possible.

14 Claims, 18 Drawing Sheets

(56) References Cited

U.S. PATENT DOCUMENTS

| | | | | |
|---|---|---|---|---|
| 7,349,146 | B1 | 3/2008 | Douglass et al. | |
| 7,504,050 | B2 | 3/2009 | Weng et al. | |
| 7,733,311 | B2 | 6/2010 | Amundson et al. | |
| 7,800,580 | B2 | 9/2010 | Johnson et al. | |
| 7,839,381 | B2 | 11/2010 | Zhou et al. | |
| 7,999,787 | B2 | 8/2011 | Amundson et al. | |
| 8,035,611 | B2 | 10/2011 | Sakamoto | |
| 2002/0021483 | A1 | 2/2002 | Katase | |
| 2002/0033792 | A1 | 3/2002 | Inoue | |
| 2003/0095090 | A1 | 5/2003 | Ham | |
| 2003/0137521 | A1 | 7/2003 | Zehner et al. | |
| 2004/0246562 | A1 | 12/2004 | Chung et al. | |
| 2004/0263450 | A1 | 12/2004 | Lee et al. | |
| 2005/0001812 | A1* | 1/2005 | Amundson et al. | 345/107 |
| 2005/0162377 | A1 | 7/2005 | Zhou et al. | |
| 2005/0179642 | A1 | 8/2005 | Wilcox et al. | |
| 2005/0185003 | A1 | 8/2005 | Dedene et al. | |
| 2005/0210405 | A1 | 9/2005 | Ernst et al. | |
| 2005/0219184 | A1 | 10/2005 | Zehner et al. | |
| 2006/0050361 | A1 | 3/2006 | Johnson | |
| 2006/0132426 | A1 | 6/2006 | Johnson | |
| 2006/0139305 | A1 | 6/2006 | Zhou et al. | |
| 2006/0139309 | A1 | 6/2006 | Miyasaka | |
| 2006/0164405 | A1 | 7/2006 | Zhou | |
| 2006/0187186 | A1 | 8/2006 | Zhou et al. | |
| 2006/0262147 | A1 | 11/2006 | Kimpe et al. | |
| 2007/0035510 | A1 | 2/2007 | Zhou et al. | |
| 2007/0046621 | A1 | 3/2007 | Suwabe et al. | |
| 2007/0046625 | A1 | 3/2007 | Yee | |
| 2007/0052668 | A1 | 3/2007 | Zhou et al. | |
| 2007/0070032 | A1 | 3/2007 | Chung et al. | |
| 2007/0080926 | A1 | 4/2007 | Zhou et al. | |
| 2007/0080928 | A1 | 4/2007 | Ishii et al. | |
| 2007/0103427 | A1 | 5/2007 | Zhou et al. | |
| 2007/0109274 | A1 | 5/2007 | Reynolds | |
| 2007/0146306 | A1 | 6/2007 | Johnson et al. | |
| 2007/0159682 | A1 | 7/2007 | Takanak et al. | |
| 2007/0182402 | A1 | 8/2007 | Kojima | |
| 2007/0188439 | A1 | 8/2007 | Kimura et al. | |
| 2007/0247417 | A1 | 10/2007 | Miyazaki et al. | |
| 2007/0262949 | A1 | 11/2007 | Zhou et al. | |
| 2007/0276615 | A1 | 11/2007 | Cao et al. | |
| 2007/0296690 | A1 | 12/2007 | Nagasaki | |
| 2008/0150886 | A1 | 6/2008 | Johnson et al. | |
| 2008/0211833 | A1* | 9/2008 | Inoue | 345/690 |
| 2008/0303780 | A1* | 12/2008 | Sprague et al. | 345/107 |
| 2009/0096745 | A1 | 4/2009 | Sprague et al. | |
| 2009/0267970 | A1 | 10/2009 | Wong et al. | |
| 2010/0134538 | A1 | 6/2010 | Sprague et al. | |
| 2010/0194733 | A1 | 8/2010 | Lin et al. | |
| 2010/0194789 | A1 | 8/2010 | Lin et al. | |
| 2010/0283804 | A1 | 11/2010 | Sprague et al. | |
| 2010/0295880 | A1 | 11/2010 | Sprague et al. | |
| 2011/0175945 | A1 | 7/2011 | Lin | |

FOREIGN PATENT DOCUMENTS

| | | |
|---|---|---|
| WO | WO 2005/034076 | 4/2005 |
| WO | WO 2009/049204 | 4/2009 |
| WO | WO 2010/132272 | 11/2010 |

OTHER PUBLICATIONS

U.S. Appl. No. 12/115,513, filed May 5, 2008, Sprague et al.

U.S. Appl. No. 12/909,752, filed Oct. 21, 2010, Sprague et al.

U.S. Appl. No. 13/004,763, filed Jan. 11, 2011, Lin et al.

U.S. Appl. No. 61/311,693, filed Mar. 8, 2010, Chan et al.

U.S. Appl. No. 61/351,764, filed Jun. 4, 2010, Lin.

U.S. Appl. No. 61/412,746, filed Nov. 11, 2010, Lin et al.

Kao, WC., Ye, JA., Chu, Mi., and Su, CY. (Feb. 2009) Image Quality Improvement for Electrophoretic Displays by Combining Contrast Enhancement and Halftoning Techniques. *IEEE Transactions on Consumer Electronics*, 2009, vol. 55, Issue 1, pp. 15-19.

Kao, WC., (Feb. 2009) Configurable Timing Controller Design for Active Matrix Electrophoretic Dispaly. *IEEE Transactions on Consumer Electronics*, 2009, vol. 55, Issue 1, pp. 1-5.

Kao, WC., Ye, JA., and Lin, C. (Jan. 2011) Image Quality Improvement for Electrophoretic Displays by Combining Contrast Enhancement and Halftoning Techniques. *ICCE 2009 Digest of Technical Papers*, 11.2-2.

Kao, WC., Ye, JA., Lin, FS., Lin, C., and Sprague, R. (Jan. 2009) Configurable Timing Controller Design for Active Matrix Electrophoretic Display with 16 Gray Levels. *ICCE 2009 Digest of Technical Papers*, 10.2-2.

Kao, WC., Fang, CY., Chen, YY., Shen, MH., and Wong, J. (Jan. 2008) Integrating Flexible Electrophoretic Display and One-Time Password Generator in Smart Cards. *ICCE 2008 Digest of Technical Papers*, p. 4-3. (Int'l Conference on Consumer Electronics, Jan. 9-13, 2008).

U.S. Appl. No. 13/471,004, filed May 14, 2012, Sprague et al.

U.S. Appl. No. 13/597,089, filed Aug. 28, 2012, Sprague et al.

* cited by examiner

Each Phase = 10 Frames

Next Image

Current Image

| | |
|---|---|
| K-W<br>+10 | K-K<br>0 |
| W-W<br>0 | W-K<br>-10 |

Pixel Counter Table

| From | To | Driving Data |
|---|---|---|
| Black | G1 | +3 |
| Black | G2 | +7 |
| White | G1 | -7 |
| White | G2 | -3 |
| G1 | Black | -3 |
| G1 | White | +7 |
| G1 | G2 | +4 |
| G2 | Black | -7 |
| G2 | White | +3 |
| G2 | G1 | -4 |

Figure 15

Current Image

Next Image

| | |
|---|---|
| G1-W<br>+7 | K-K<br>0 |
| W-W<br>0 | W-G2<br>-3 |

Pixel Counter Table

DRIVING METHODS FOR ELECTROPHORETIC DISPLAYS

This application claims priority to U.S. Provisional Application No. 61/296,832, filed Jan. 20, 2010; the content of which is incorporated herein by reference in its entirety.

BACKGROUND OF THE INVENTION

An electrophoretic display (EPD) is a non-emissive device based on the electrophoresis phenomenon of charged pigment particles suspended in a solvent. The display usually comprises two plates with electrodes placed opposing each other and one of the electrodes is transparent. A suspension composed of a colored solvent and charged pigment particles dispersed therein is enclosed between the two plates. When a voltage difference is imposed between the two electrodes, the pigment particles migrate to one side or the other, causing either the color of the pigment particles or the color of the solvent to be seen, depending on the polarity of the voltage difference.

In order to obtain a desired image, driving waveforms are required for an electrophoretic display. A driving waveform consists of a series of voltages applied to each pixel to allow migration of the pigment particles in the electrophoretic fluid.

In the current driving system, when an image is to be updated, a display controller compares current image and next image, finds appropriate waveforms in a look-up table and then sends the selected waveforms to the display to drive current image to next image, and this entire process is carried out, frame by frame.

With this current system, if after the command to drive current image to next image is received and before the updating is complete, there is a new command to update to a different desired image, this second command, however, does not automatically override the first command. This is due to the fact that after the selected waveforms have been sent to the display, the waveforms must be completed before a new command can be executed. In other words, the current driving system is not interruptible. In light of this shortcoming, the current method is particularly undesirable in a situation where user interaction with an electronic device (such as an e-book) is an essential feature.

SUMMARY OF THE INVENTION

The present invention is directed to a driving method for updating current image to next image, which method comprises:

a) comparing the two images;
b) finding driving data for each pixel in a look-up table based on the comparison of the two images;
c) mathematically adding the driving data for each pixel to an existing pixel counter table to form a current pixel counter table; and
d) updating the current image to the next image based on the current pixel counter table.

The driving method may be based on mono-polar driving waveforms, in which pixels of a first color are driven to the second color in a first phase and pixels of the second color are driven to the first color in a second phase.

In one embodiment, the driving sequence comprises one or more first phase and one or more second phase.

In another embodiment, the driving is carried out with the first phase and the second phase in an order, depending on the interrupting commands. In one case, after receiving an interrupting command, the first phase driving must all be completed before the second phase driving. In another case, after receiving an interrupting command, the second phase driving must all be completed before the first phase driving.

In a further embodiment, after receiving the interrupting command, the choice of first driving the first phase or the second phase would depend on the state of the driving before the interrupting command. More specifically, immediately before and after the interrupting command, the driving is carried out in the same phase (i.e., the first phase or the second phase).

In yet a further embodiment, the first phase and the second phase are carried out in an interleaving manner. In this case, if the first phase is first driven for X number of frames, which would immediately be followed by driving in the second phase for the same number of frames. The number X may be any integer. In each set of the first phase and the second phase, the first phase may be driven first followed by the second phase, or vice versa.

The driving method may also be carried out by bi-polar waveforms. The pixel counter table can store both the positive and negative driving data together. For bi-polar driving, driving from the first color to the second color and driving from the second color to the first color can take place in the same phase.

The driving system and methods of the present invention enable interruption of updating images. The system and methods not only have the advantage that they can prevent overdriving of an electrophoretic display, but they also allow updating images in the highest speed possible. The overdriving phenomenon is usually caused by continuing applying a voltage to a medium even after the medium has reached the desired color state. As a result, overdriving often causes undesirable performance issues, for example, poor bistability.

BRIEF DESCRIPTION OF THE DRAWINGS

FIG. 15 is a table summarizing driving data for images having two grey levels G1 and G2.

DETAILED DESCRIPTION OF THE INVENTION

Definitions

The terms, "first" and "second" color states, are intended to refer to any two contrast colors. While the black and white colors are specifically referred to in illustrating the present invention, it is understood that the present invention is applicable to any two contrast colors in a binary color system.

The terms, "current" and "next" images referred to, throughout the present application, are two consecutive images and "current image" is to be updated to "next image".

Figure 1:
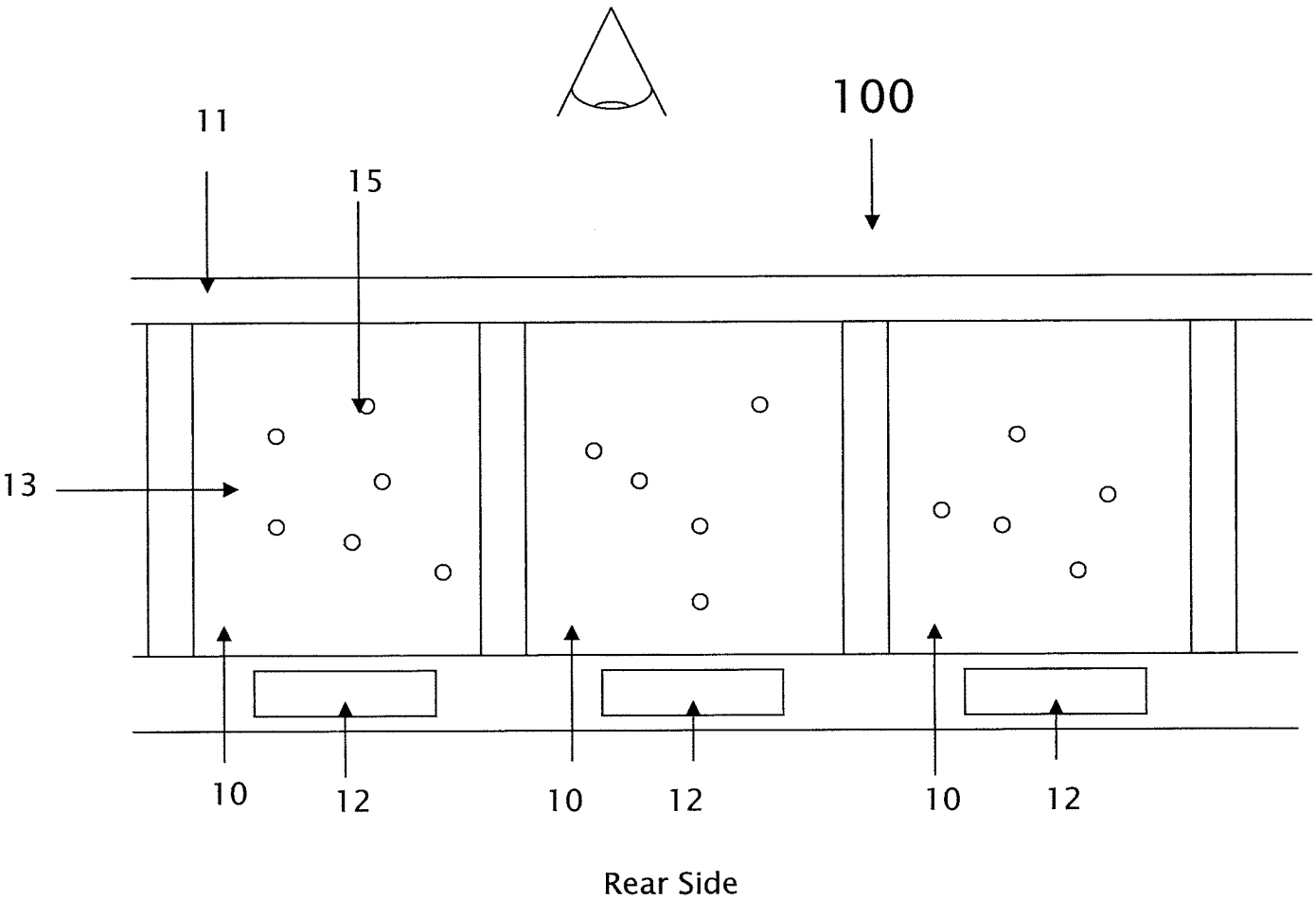
FIG. 1 is a cross-section view of a typical electrophoretic display device.

FIG. 1 illustrates a typical electrophoretic display 100 comprising a plurality of electrophoretic display cells 10. In FIG. 1, the electrophoretic display cells 10, on the front viewing side indicated with the graphic eye, are provided with a common electrode 11 (which is usually transparent and therefore on the viewing side). On the opposing side (i.e., the rear side) of the electrophoretic display cells 10, a substrate includes discrete pixel electrodes 12. Each of the pixel electrodes defines an individual pixel of the electrophoretic display. In practice, a single display cell may be associated with one discrete pixel electrode or a plurality of display cells may be associated with one discrete pixel electrode.

An electrophoretic fluid 13 comprising charged pigment particles 15 dispersed in a solvent is filled in each of the display cells. The movement of the charged particles in a display cell is determined by the driving voltage associated with the display cell in which the charged particles are filled.

If there is only one type of pigment particles in the electrophoretic fluid, the pigment particles may be positively charged or negatively charged. In another embodiment, the electrophoretic display fluid may have a transparent or lightly colored solvent or solvent mixture and charged particles of two different colors carrying opposite charges, and/or having differing electro-kinetic properties.

The display cells may be of a conventional walled or partition type, a microencapsulated type or a microcup type. In the microcup type, the electrophoretic display cells may be sealed with a top sealing layer. There may also be an adhesive layer between the electrophoretic display cells and the common electrode. The term "display cell" therefore is intended to refer to a micro-container which is individually filled with a display fluid. Examples of "display cell" include, but are not limited to, microcups, microcapsules, micro-channels, other partition-typed display cells and equivalents thereof.

The term "driving voltage" is used to refer to the voltage potential difference experienced by the charged particles in the area of a pixel. The driving voltage is the potential difference between the voltage applied to the common electrode and the voltage applied to the pixel electrode. As an example, in a binary system, positively charged white particles are dispersed in a black solvent. When zero voltage is applied to a common electrode and a voltage of +15V is applied to a pixel electrode, the "driving voltage" for the charged pigment particles in the area of the pixel would be +15V. In this case, the driving voltage would move the positively charged white particles to be near or at the common electrode and as a result, the white color is seen through the common electrode (i.e., the viewing side). Alternatively, when zero voltage is applied to a common electrode and a voltage of −15V is applied to a pixel electrode, the driving voltage, in this case, would be −15V and under such −15V driving voltage, the positively charged white particles would move to be at or near the pixel electrode, causing the color of the solvent (black) to be seen at the viewing side.

Figure 2:
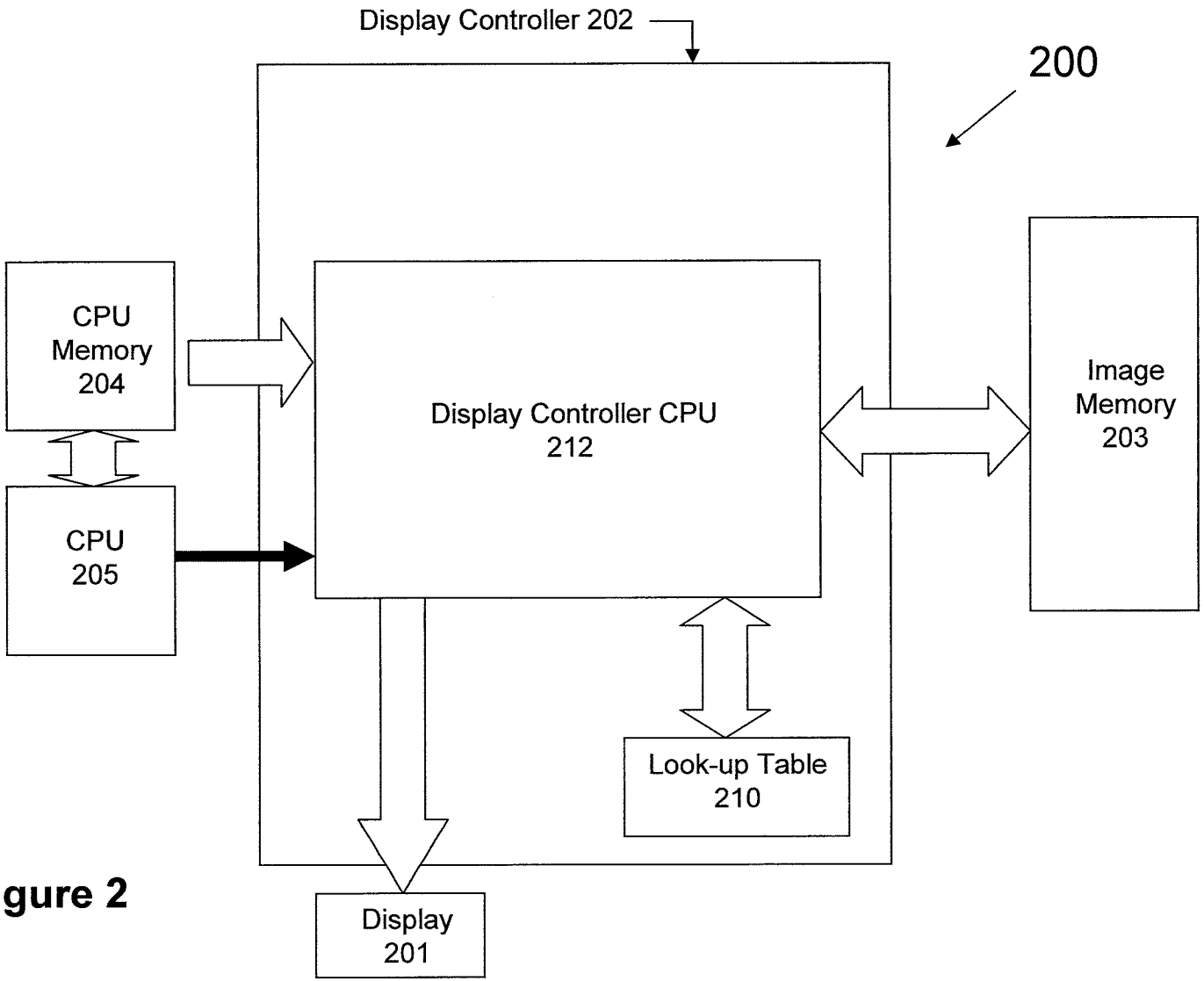
FIG. 2 illustrates a display controller system.

An example of a display controller system 200 is shown in FIG. 2. The CPU 205 is able to read to or write to CPU memory 204. In a display application, the images are stored in the CPU memory 204. When an image is to be displayed, the CPU 205 sends a request to the display controller 202. CPU 205 then instructs the CPU memory 204 to transfer the image data to the display controller 202.

When an image update is being carried out, the display controller CPU 212 accesses current image and next image from the image memory 203 and compares the two images. Based on the comparison, the display controller CPU 212 consults a lookup table 210 to find the appropriate waveform for each pixel. More specifically, when driving from current image to next image, a proper driving waveform is selected from the look up table for each pixel, depending on the color states in the two consecutive images of that pixel. For example, a pixel may be in the white state in current image and in the level 5 grey state in next image; a waveform is chosen accordingly.

The selected driving waveforms are sent to the display 201 to be applied to the pixels to drive current image to next image. Currently, this entire process (from comparing the two images to sending selected waveforms to the display) is carried out at each frame.

In practice, the common electrode and the pixel electrodes are separately connected to two individual circuits and the two circuits in turn are connected to the display controller. The display controller sends waveforms, frame to frame, to the circuits to apply appropriate voltages to the common and pixel electrodes respectively. The term "frame" represents timing resolution of a waveform and is illustrated in a section below.

The pixel electrodes may be on a TFT (thin film transistor) backplane.

Figure 3:
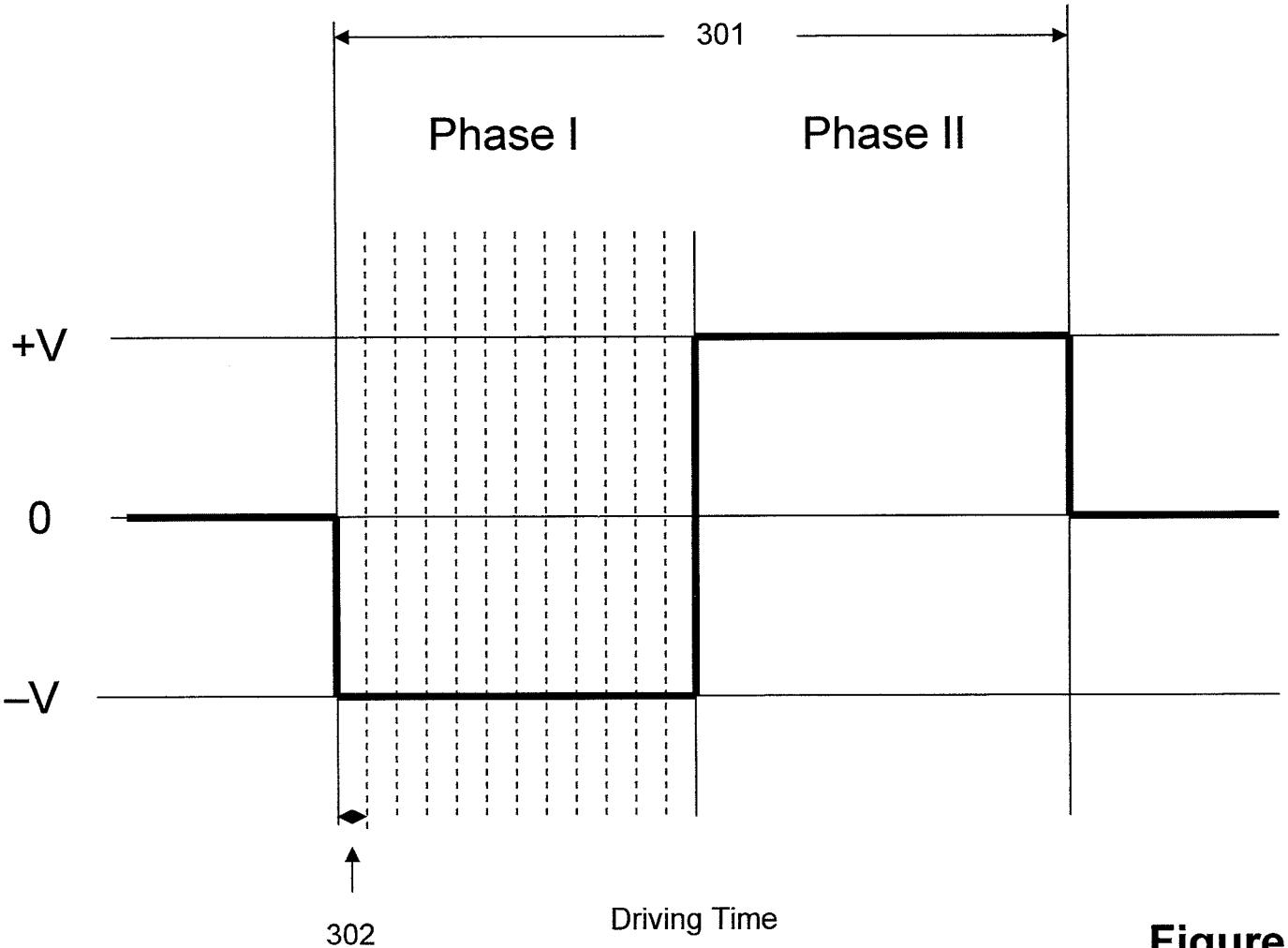
FIG. 3 illustrates an example driving waveform.

FIG. 3 shows an example of a driving waveform for a single pixel. For a driving waveform, the vertical axis denotes the intensity of the applied voltages whereas the horizontal axis denotes the driving time. The length of 301 is the driving waveform period. There are two driving phases, I and II, in this example driving waveform.

There are frames 302 within the driving waveform as shown. When driving an EPD on an active matrix backplane, it usually takes many frames for the image to be displayed. During each frame, a voltage is applied to a pixel. For example, during frame period 302, a voltage of −V is applied to the pixel.

The length of a frame is an inherent feature of an active matrix TFT driving system and it is usually set at 20 msec (millisecond). But typically, the length of a frame may range from 2 msec to 100 msec.

There may be as many as 1000 frames in a waveform period, but usually there are 20-40 frames in a waveform period.

In the example waveform, there are 12 frame periods in phase I of the driving waveform. Assuming phase I and phase II have the same driving time, and then this waveform would have 24 frames. Given the frame length being 20 msec, the waveform period 301 would be 480 msec.

It is noted the numbers of frames in the two phases do not have to be the same.

Figure 4:
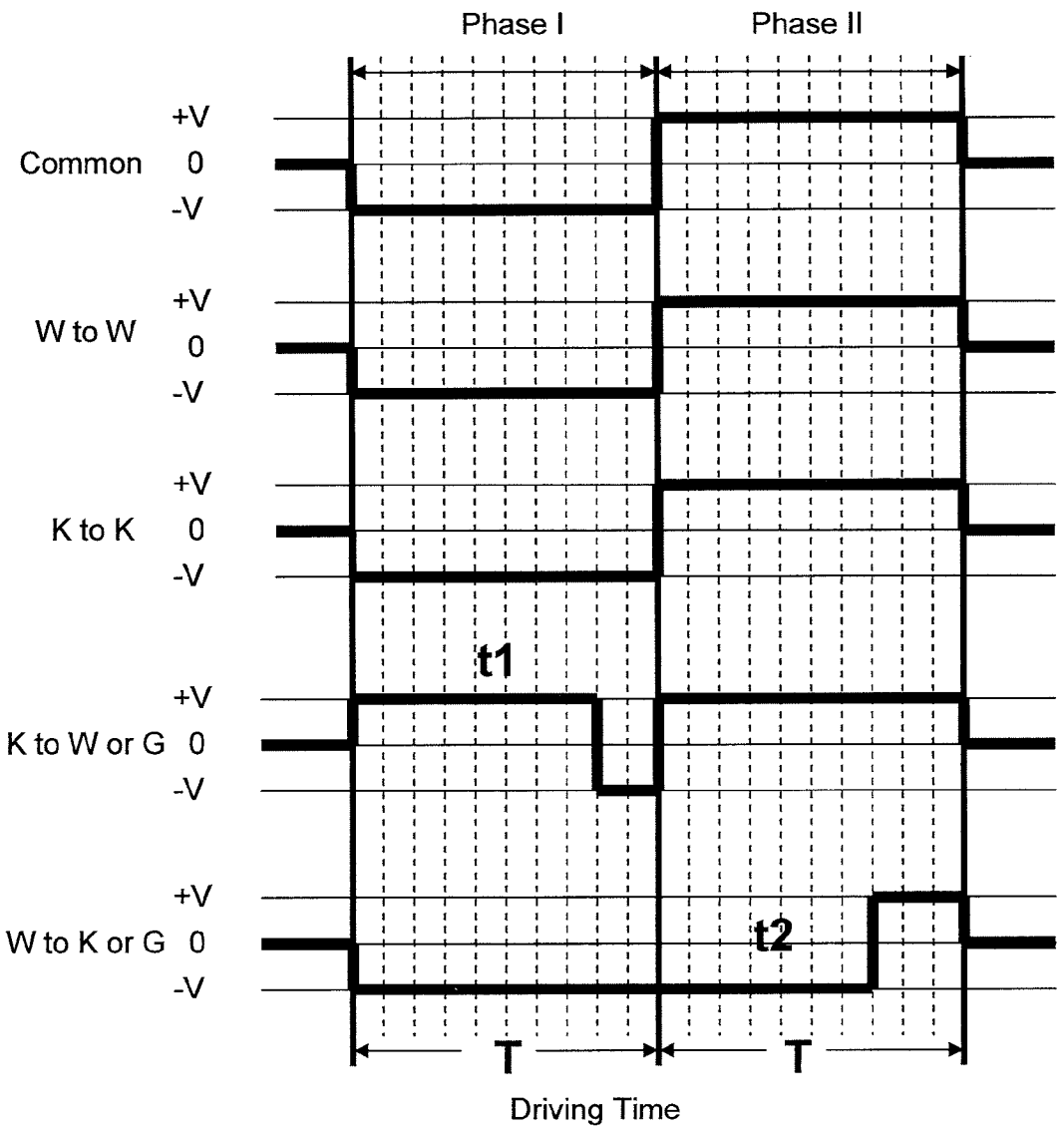
FIG. 4 illustrates a set of mono-polar driving waveforms applicable to the present invention.

FIG. 4 shows a specific set of mono-polar driving waveforms applicable for the present invention. It is assumed in this example that the charged pigment particles are white and positively charged and they are dispersed in a black solvent.

For the common electrode, a voltage of −V is applied in phase I and a voltage of +V is applied in phase II. For a white pixel to remain in the white state and a black pixel to remain in the black state, the voltages applied to the pixel both in phase I and phase II are the same as those applied to the common electrode, thus zero "driving voltage".

For a black (K) pixel to be driven to the white (W) or grey (G) state, in Phase I, the pixel electrode is applied a voltage of +V for a period of t1. If the time duration of t1 is equal to T (i.e., 10 frames), the pixel would be driven to the full white state. If the time duration of t1 is between 0 and T (i.e., less than 10 frames), the pixel would be in a grey state and the longer t1 is, the lighter the grey color. After t1 in Phase I, the driving voltage is 0V, thus allowing the pixel to remain in the same color state as that at the end of t1. Therefore, the K to W or G waveform is capable of driving a pixel from the black color state to a white or grey color state (in Phase I).

For a white (W) pixel to be driven to the black (K) or grey (G) state, in Phase I, the driving voltage is 0V. However in Phase II, the pixel is applied a voltage of −V for a period of t2. If the time duration of t2 is equal to T (i.e., 10 frames), the pixel would be driven to the full black state. If the time duration of t2 is between 0 and T (i.e., less than 10 frames), the pixel would be in a grey state and the longer t2 is, the darker the grey color. After t2 in Phase II, the driving voltage is 0V, thus allowing the pixel to remain in the same color state as that at the end of t2. Therefore, the W to K or G waveform is capable of driving a pixel from the white color state to a black or grey color state.

It is noted that when this set of mono-polar waveforms are applied to update images, the black pixels always change to the white color (in phase I) before the white pixels change to the black color (in phase II). The waveforms, however, can easily be modified to allow that the white pixels change to the black color (in phase I) before the black pixels change to the white color (in phase II).

For mono-polar driving, the pixel electrodes for the pixels driven from a first color to a second color and the pixel electrodes for the pixels driven from the second color to the first color are modulated with the same common electrode. More specifically, for example, when the common electrode is applied a positive voltage (+V), the pixel electrodes can only be applied a negative voltage (−V) or no voltage (0V), in order to achieve a driving voltage (−2V or −V). In the case of the pixel electrodes being applied a positive voltage (+V), in this case, there would be no driving voltage, because of which the driving pixels from the first color to the second color and the driving pixels from the second color to the first color cannot occur in the same phase, in mono-polar driving.

Figure 5:
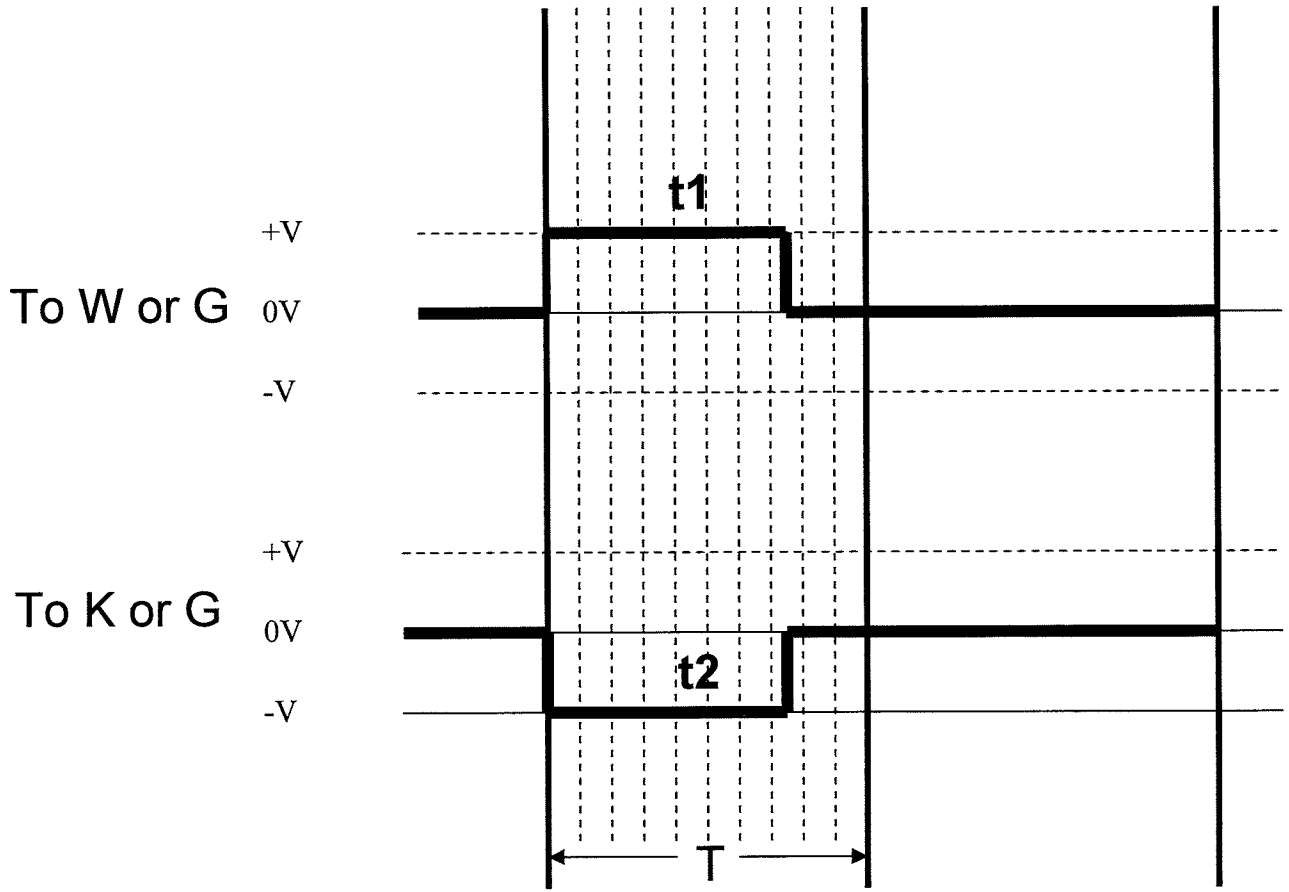
FIG. 5 shows a set of bi-polar driving waveforms applicable to the present invention.

FIG. 5 shows a set of bi-polar driving waveforms, also applicable for the present invention. It is also assumed in this example that the charged pigment particles are white and positively charged and they are dispersed in a black solvent.

For the bi-polar waveforms, the common electrode is always set at ground. Therefore it is possible to update pixels from black to white and also pixels from white to black, in the same driving phase. In other words, the bi-polar approach requires no modulation of the common electrode and the driving from one image to another image may be accomplished, as stated, in the same driving phase.

As shown in FIG. 5, in the "to White (W) or Grey (G)" waveform, if the time duration of t1 is equal to T (i.e., 10 frames), the pixel would be driven to the full white state and if the time duration of t1 is between 0 and T (i.e., less than 10 frames), the pixel would be in a grey state. The longer $t_1$ is, the lighter the grey color. In the "to Black (K) or Grey (G)" waveform, if the time duration of t2 is equal to T (i.e., 10 frames), the pixel would be driven to the full black state and if the time duration of t2 is between 0 and T (i.e., less than 10 frames), the pixel would be in a grey state. The longer t2 is, the darker the grey color.

The present invention is directed to a rapid updating driving method. In particular, the method comprises the use of a pixel counter table.

The first aspect of the invention is directed to a pixel counter table which is a table comprising data for driving each pixel from current image to next image. The driving data represent the voltage applied during each driving frame and how many driving frames are needed to arrive at the desired color state for each pixel. An example of a pixel counter table is given in Example 1 below.

The pixel counter table is generated by a display controller, using the following algorithm:

K (black) to K (black)→0
K (black) to W (white)→+N
W (white) to K (black)→−M
W (white) to W (white)→0

The white color and black color indicated may be generalized to any two contrasting colors, referred to as a first color and a second color.

The symbols M and N indicate the numbers of frames required to update a pixel from a color state in current image to another color state in next image. M may be equal to N.

In an alternative scenario, the pixel counter table may be generated by a display controller, using the following algorithm:

K (black) to K (black)→0
K (black) to W (white)→−N
W (white) to K (black)→+M
W (white) to W (white)→0

If a pixel counter table indicates +8 for a pixel, it means that it takes 8 positive pulses, or a positive voltage applied for 8 frames, in order to update that pixel to the targeting color state. If a pixel counter table indicates −8 for a pixel, it means that it takes 8 negative pulses, or a negative voltage applied for 8 frames, in order to update that pixel to the desired color state.

Each pulse represents a driving frame on an active matrix panel. As stated previously, a frame can be ranged from 2 msec to 100 msec, depending on the design of the TFT panel and the driver ICs.

The pixel counter table stores the driving data and at the start of each frame, a display controller will use the data to generate a signal and send the signal to the source driver IC. After driving of a frame is finished, the number in the driving data will change accordingly. For example, if the pixel counter table indicates +10 for a pixel, after one frame is driven with a positive voltage, the pixel counter table will change to +9 for that pixel. Likewise, if the pixel counter table indicates −10 for a pixel, after one frame is driven with a negative voltage, the pixel counter table will change to −9 for that pixel.

Although the algorithm above only shows the two extreme color states, black and white, it can be extended to grey levels as well.

The use of a pixel counter table has many advantages. Most notably, when updating current image to next image, the display controller needs to compare the two images only once. More specifically, the display controller compares the two images, finds the driving data (i.e., proper waveforms) in a look-up table and then mathematically adds the driving data to an existing pixel counter table for each pixel to form a current pixel counter table. The driving then continues based on the driving data in the current pixel counter table. In other words, in the driving method of the present invention, the display controller does not have to compare the two images for every frame, which is an essential step in the prior art method.

The second aspect of the present invention is directed to a driving method for updating current image to next image, which method comprises:

e) comparing the two images;

f) finding driving data for each pixel in a look-up table based on the comparison of the two images;

g) mathematically adding the driving data for each pixel to an existing pixel counter table to form a current pixel counter table; and h) updating the current image to the next image based on the current pixel counter table.

The driving method may be based on mono-polar driving waveforms, in which pixels of a first color are driven to the second color in a first phase and pixels of the second color are driven to the first color in a second phase.

In one embodiment, the driving sequence comprises one or more first phase and one or more second phase.

In another embodiment, the driving is carried out with the first phase and the second phase in an order, depending on the interrupting commands. In one case, after receiving an interrupting command, the first phase driving must all be completed before the second phase driving. In another case, after receiving an interrupting command, the second phase driving must all be completed before the first phase driving.

In a further embodiment, after receiving the interrupting command, the choice of first driving the first phase or the second phase would depend on the state of the driving before the interrupting command. More specifically, immediately before and after the interrupting command, the driving is carried out in the same phase (i.e., the first phase or the second phase).

In yet a further embodiment, the first phase and the second phase are carried out in an interleaving manner. In this case, if the first phase is first driven for X number of frames, which would immediately be followed by driving in the second phase for the same number of frames. The number X may be any integer. In each set of the first phase and the second phase, the first phase may be driven first followed by the second phase, or vice versa.

The driving method may also be carried out by bi-polar waveforms. The pixel counter table can store both the positive and negative driving data together. For bi-polar driving, driving from the first color to the second color and driving from the second color to the first color can take place in the same phase.

EXAMPLES

Figure 6:
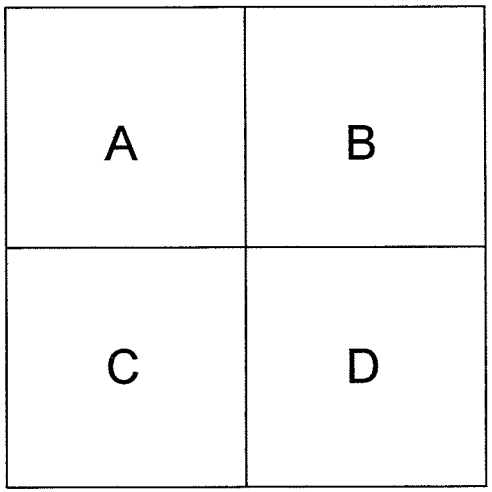
FIG. 6 is an example of an image having four pixels (A-D).

It is understood that each image may consist of a large number of pixels. However, for ease of illustration, an image of only four pixels, A, B, C & D as shown in FIG. 6 is used in the following examples.

The driving methods of the examples are carried out utilizing the waveforms of FIG. 4 or FIG. 5.

Example 1

Pixel Counter Table

Figure 7:
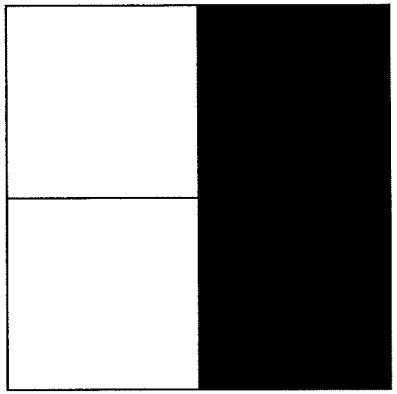
FIG. 7 illustrates a pixel counter table for a 4-pixel image being updated from current image to next image.
Figure 7:
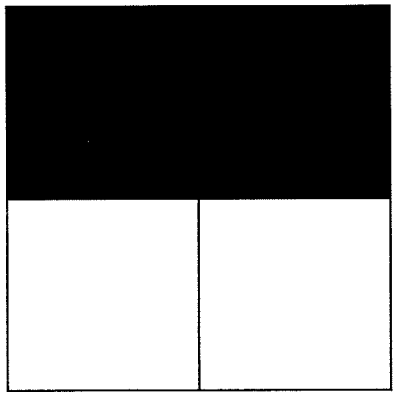

This example is shown in FIG. 7. The current image has pixels A and B in the black state and pixels C and D in the white state and the next image has pixels A and C in the white state and pixels B and D in the black state.

A display controller compares the current and next images and consults a look-up table based on the waveforms of FIG. 4. The driving data obtained from the look-up table are presented in the pixel counter table of FIG. 7.

The pixel counter table shows that while driving pixel A from black to white, a voltage of +V must be applied to the pixel for a period of ten frames, which is expressed in the table as "+10" and while driving pixel D from white to black, a voltage of −V must be applied to the pixel for a period of ten frames, which is expressed in the table as "−10".

For pixels B and C, since no color change occurs between the current image and the next image, no driving voltage is applied to these two pixels during the update.

Examples 2-4

These three examples show the driving method of the present invention in which the initial command wishes to update image A to image B and the interrupting second command wishes to update to image C. The three examples are demonstrated in FIGS. 8, 9 and 10, respectively, all driven by the mono-polar waveforms of FIG. 4.

Example 2

Figure 8:
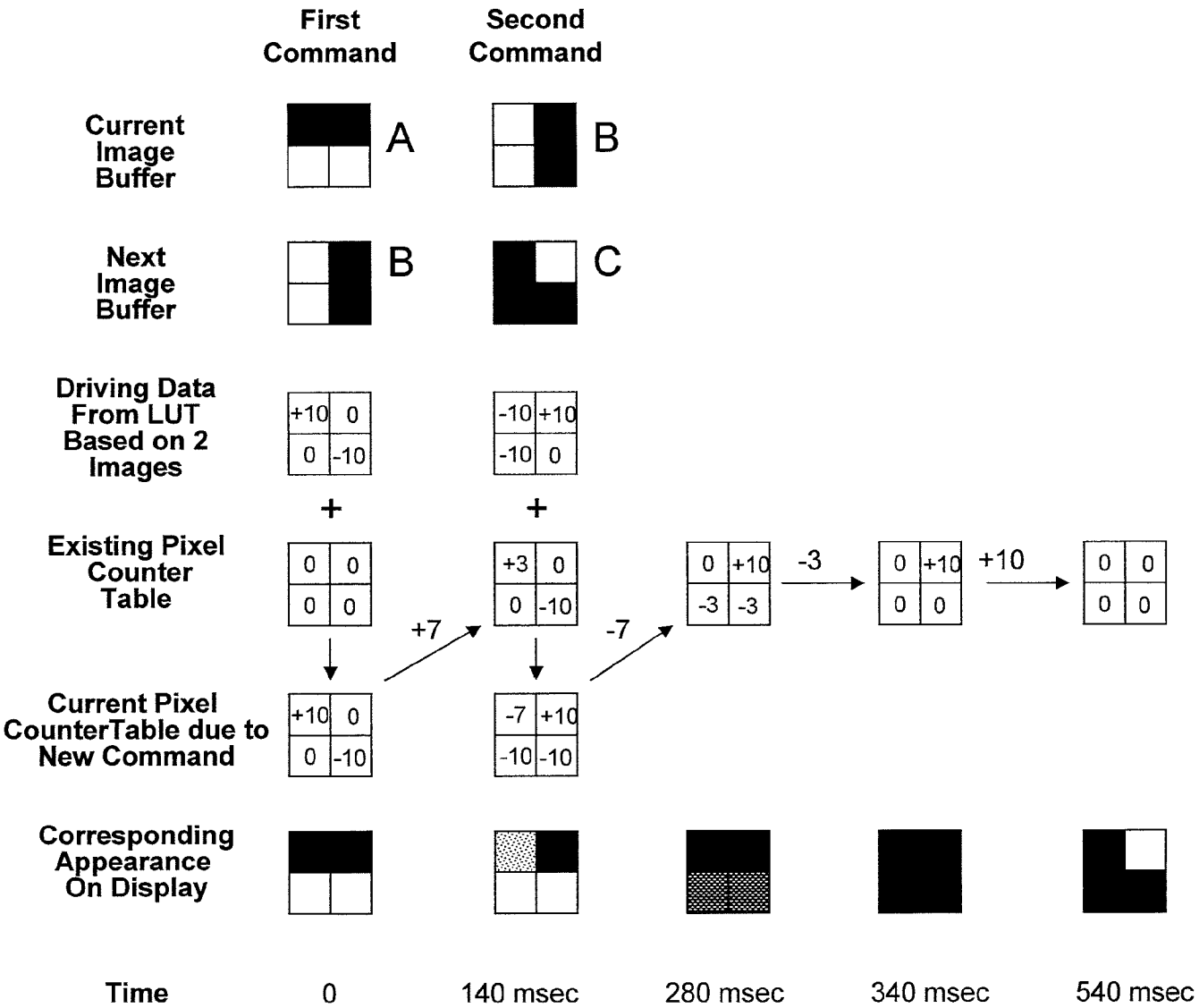
FIGS. 8-10 illustrate three mono-polar driving examples which have one interrupting command.

This example is summarized in FIG. 8.

The first command wishes to update image A to image B. The display controller compares the two images and based on the comparison finds in a look-up table the driving data with pixels A-D being, +10, 0, 0 and −10, respectively.

Since this is the first command, at the time when it is received, the existing pixel counter table has all pixels A-D being 0.

The driving data obtained are then added to the existing pixel counter table, resulting in a current pixel counter table, due to the new command, in which pixels A-D are +10, 0, 0 and −10, respectively.

In this example, after 7 frames in phase I (+7) are driven, a second command is received to update to image C. The display controller then compares images B and C and based on the comparison finds in the look-up table the driving data with pixels A-D being −10, +10, −10 and 0, respectively.

Since 7 frames in phase I (+7) have been driven, the existing pixel counter table at the time when the second recommend is received has pixels A-D being +3, 0, 0 and −10, respectively.

According to the method of the present invention, the new driving data are added to the existing pixel counter table, resulting in a current pixel counter table, due to the second command, having pixels A-D being −7, +10, −10 and −10, respectively.

The driving continues towards image C. At first, seven frames in phase II (−7) are driven, so that pixel A is updated to the desired black state (in image C) and at this time point, the remaining pixels B-D are +10, −3 and −3, respectively. This is followed by three frames in phase II (−3) being driven, leading pixels C & D to the desired black state (in image C) and the remaining pixel B being +10. In the last step, the driving in phase I (+10) is completed, leading pixel B to the desired white state (in image C).

In this example, the driving after receiving the interrupting command takes place in the order of phase II (−7), phase II (−3) and phase I (+10). The driving of the second phase is completed before starting driving of the first phase.

The "corresponding appearance" row in FIG. 8 shows the corresponding appearance on display at each time point. For example, the third image from the left shows pixels A & B being in the black state while pixels C & D being in grey.

The last row indicates the time line.

Example 3

Figure 9:
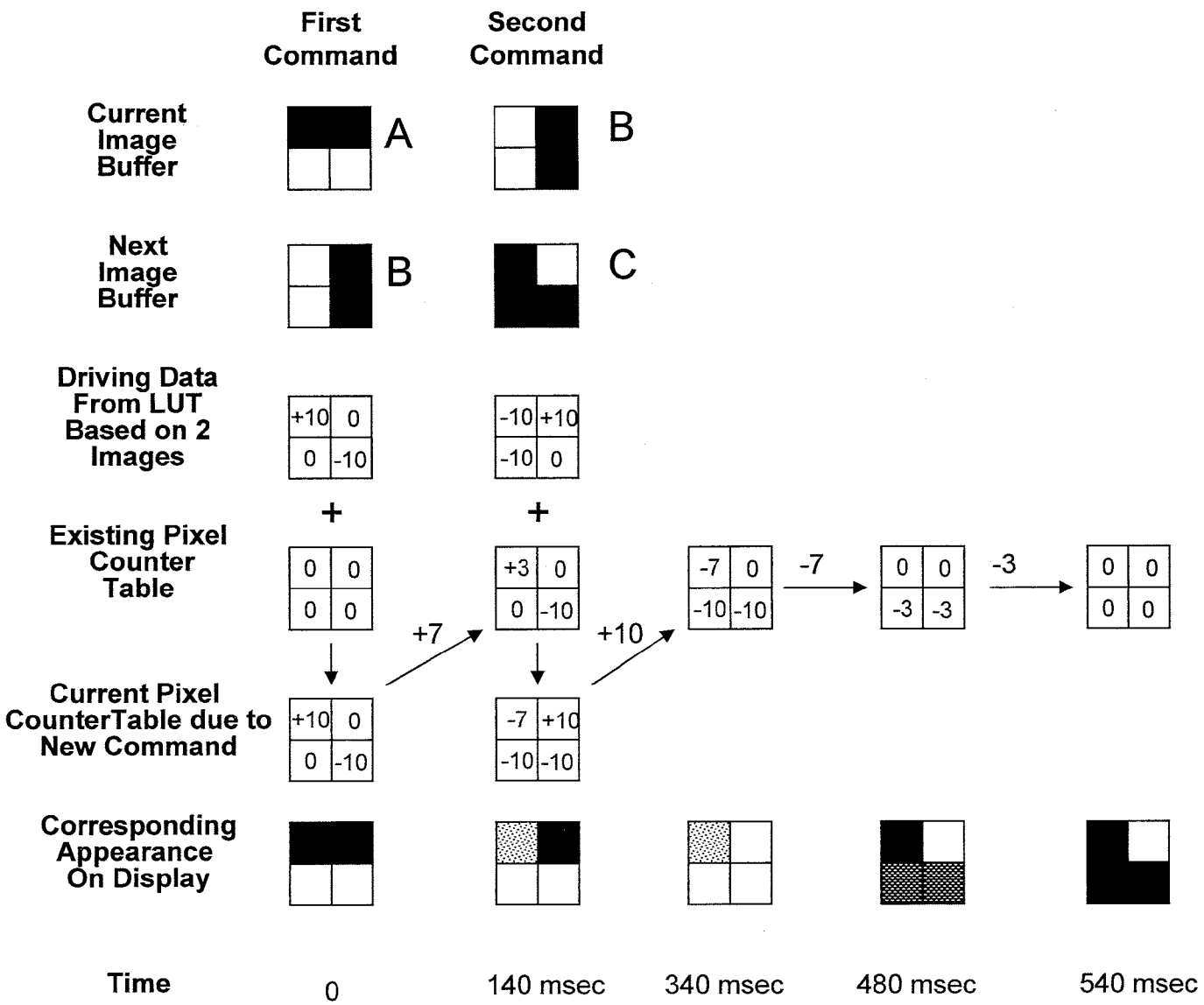

This example is summarized in FIG. 9.

In this example, the driving of the first phase takes place before and after receiving the interrupting command.

Example 4

Figure 10:
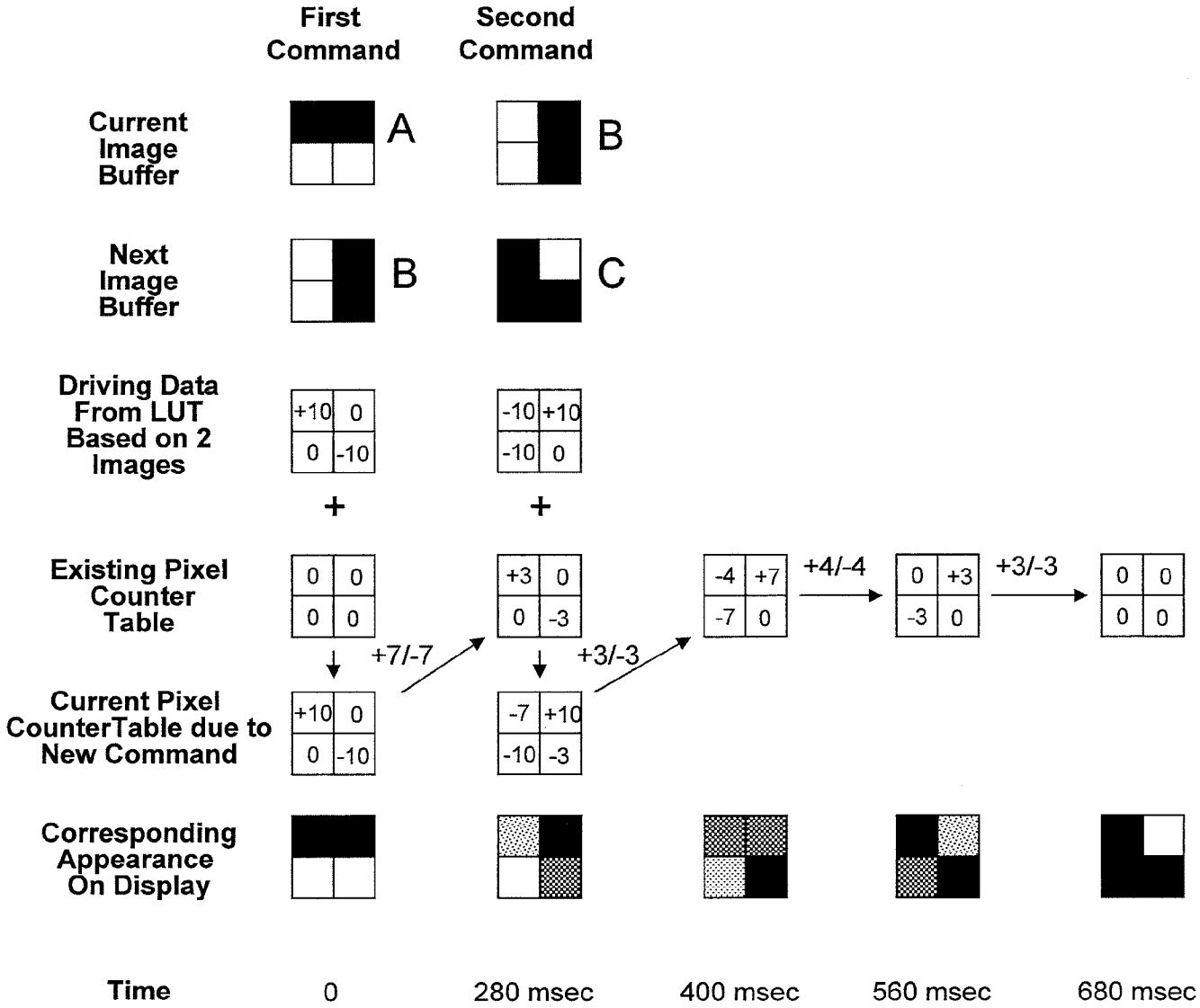

This example is summarized in FIG. 10.

In this example, phase I and phase II are alternating (i.e., in an interleaving manner).

In Example 4, the driving sequence is as follows: 7 frames in phase I and phase II, 3 frames in phase I and phase II, 4 frames in phase I and phase II and finally 3 frames in phase I and phase II.

It is noted that, for example, while seven frames are first driven in both phase I and phase II, the seven frames do not have to be driven all at once. For example, it is possible to drive in the order of 2 frames in phase I, 2 frames in phase II, 5 frames in phase I and then 5 frames in phase II. It is also possible to drive phase I and phase II, one at a time in an alternating order.

Examples 5 & 6

Both examples demonstrate the driving method of the present invention, utilizing the mono-polar waveforms of FIG. 4. In Example 5, there are two interrupting commands and in Example 6, there are three interrupting commands.

Example 5

Figure 11:
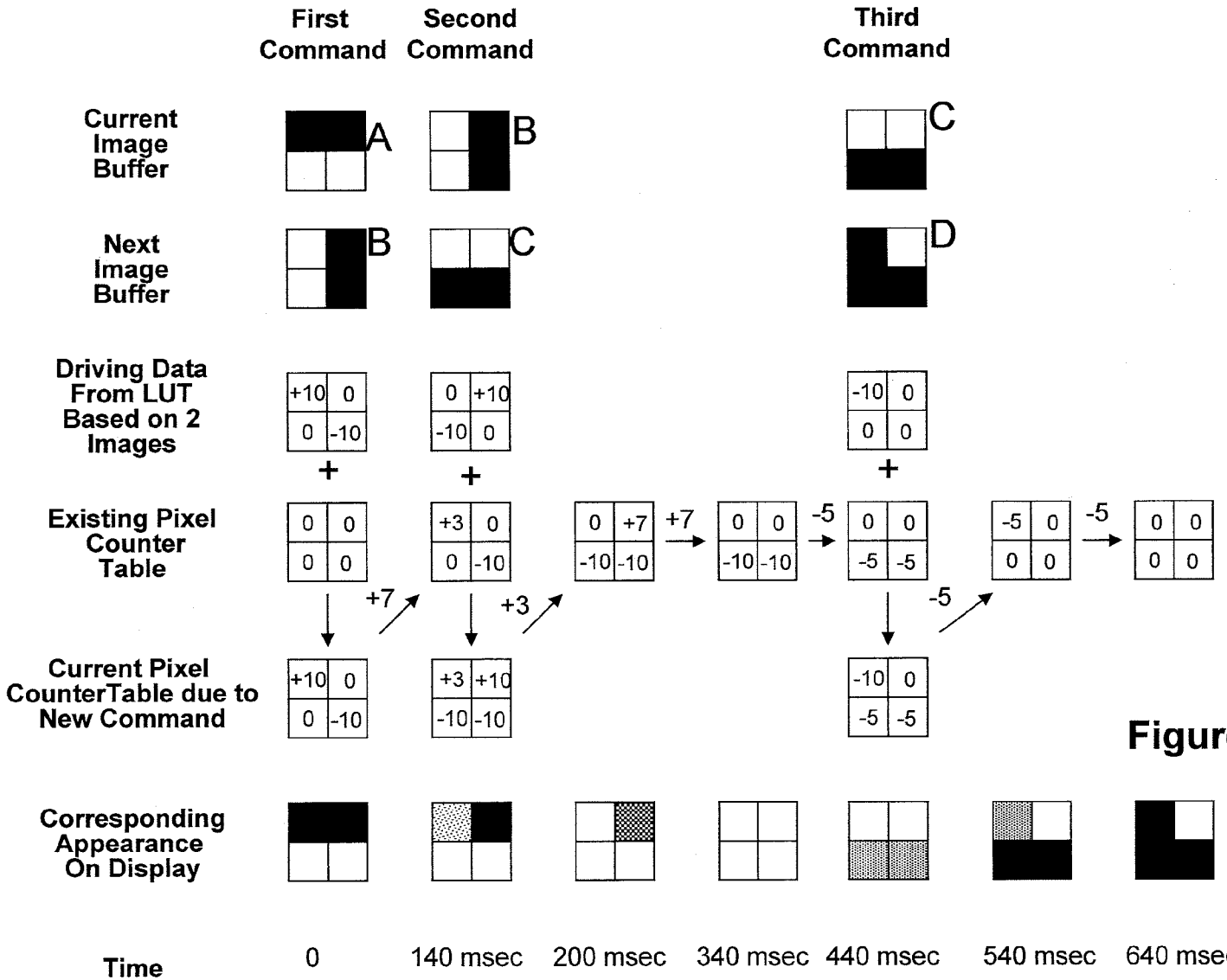
FIG. 11 illustrates a mono-polar driving example which has two interrupting commands.

In this example, there are two interrupting commands. The example is summarized in FIG. 11.

Initially, the first command wishes to update image A to image B, the second command wishes to update the image to image C and the third command wishes to update the image to image D.

As the first step, a display controller compares the images A and B and based on the comparison finds in a look-up table the driving data with pixels A-D being +10, 0, 0 and −10, respectively.

Since this is the first command, at the time when it is received, the existing pixel counter table has all pixels A-D being 0.

The driving data obtained are added to the existing pixel counter table, resulting in a current pixel counter table, due to the new command, in which pixels A-D are +10, 0, 0 and −10, respectively.

In this example, after 7 frames in phase I (+7) are driven, a second command is received to update to image C. The display controller then compares images B and C and based on the comparison finds in the look up table the driving data with pixels A-D being 0, +10, −10 and 0, respectively.

Since 7 frames in phase I (+7) have been driven, the existing pixel counter table at the time the second recommend is received has pixels A-D being +3, 0, 0 and −10, respectively.

The new driving data based on comparison of images B and C are added to the existing pixel counter table, resulting in a current pixel counter table, due to the second command, having pixels A-D being +3, +10, −10 and −10, respectively.

The driving continues towards image C. At first, three frames in phase I (+3) are driven, so that pixel A is updated to the desired white state (in image C) and at this time point, the remaining pixels B-D are +7, −10 and −10, respectively. This is followed by seven frames in phase I (+7) being driven, leading pixel B to the desired white state (in image C) and both the remaining pixels C & D being −10.

After 5 frames in phase II (−5) are driven, a third command is received to update to image D. The display controller then compares images C and D and based on the comparison finds in the look up table the driving data with pixels A-D being −10, 0, 0 and 0, respectively.

The existing pixel counter table at the time the third recommend is received has pixels A-D being 0, 0, −5 and −5, respectively.

The new driving data from comparison of image C and image D are added to the existing pixel counter table, resulting in a current pixel counter table, due to the third command, having pixels A-D being −10, 0, −5 and −5, respectively.

The driving continues towards image D. At first, five frames in phase II (−5) are driven, so that pixels B, C & D are updated to the desired white, black and black state, respectively (in image D) and at this time point, the remaining pixel A is −5. This is followed by driving five frames in phase II (−5), leading pixel A to the desired black state.

The "corresponding appearance" row shows the corresponding appearance on the display at each time point. For example, in the third image from left, pixels A, C and D are white while pixel B is in a grey state.

The last row indicates the time line.

Example 6

Figure 12:
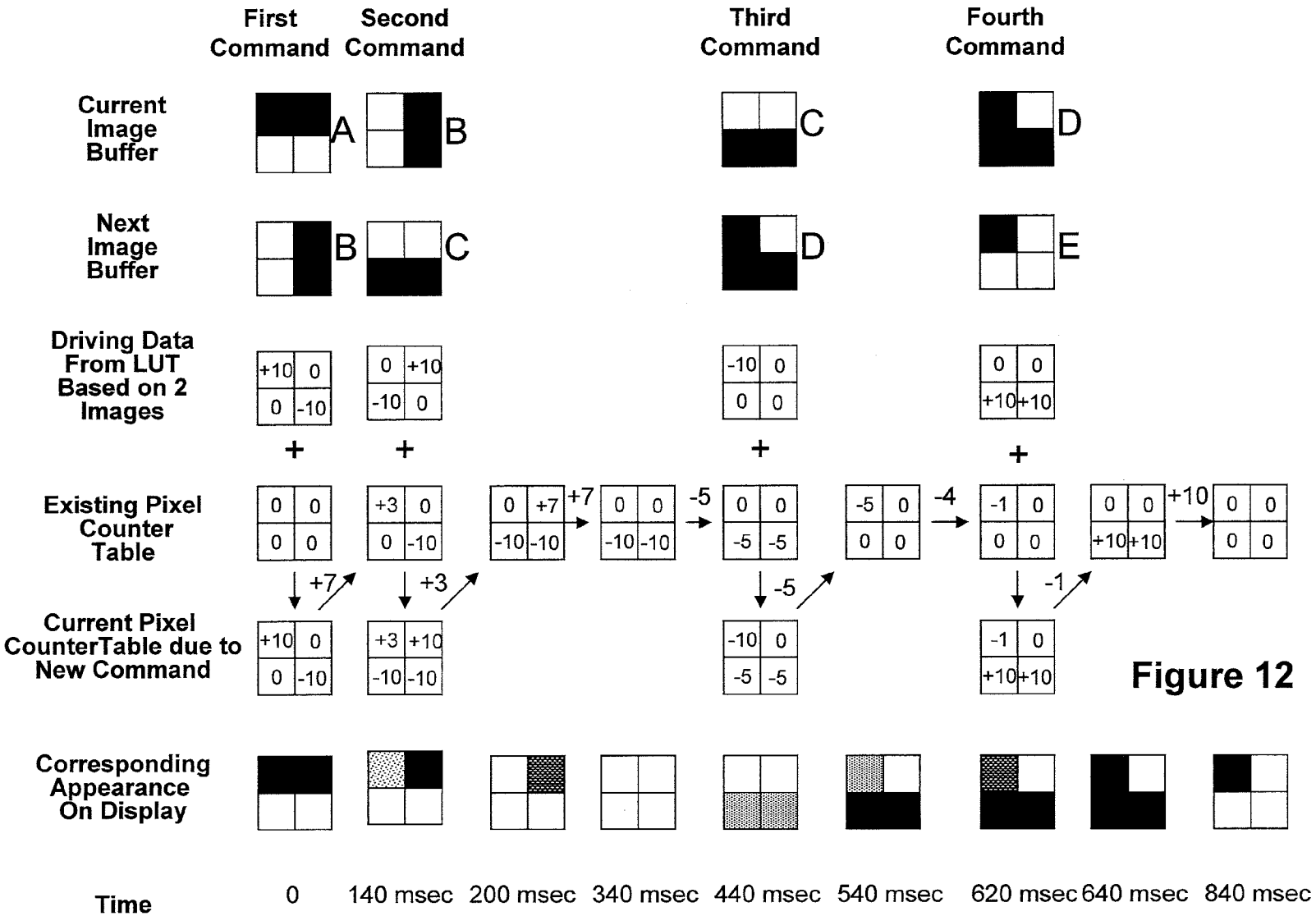
FIG. 12 illustrates a mono-polar driving example which has three interrupting commands.

In this example, there are three interrupting commands. The example is summarized in FIG. 12.

Initially, the first command wishes to update image A to image B, the second command wishes to update the image to image C, the third command wishes to update the image to image D and the fourth command wishes to update the image to image E.

The first five steps are identical to those in Example 5.

The driving continues towards image D. However, after four frames in phase II (−4) are driven, a fourth command is received to update the image to image E. The display controller then compares images D and E and based on the comparison finds in the a look-up table the driving data with pixels A-D being 0, 0, +10 and +10, respectively.

The existing pixel counter table at the time the fourth recommend is received has pixels A-D being −1, 0, 0 and 0, respectively.

The new driving data based on the comparison of image D and image E are added to the existing pixel counter table, resulting in a current pixel counter table, due to the fourth command, having pixels A-D being −1, 0, +10 and +10, respectively.

The driving continues towards image E. At first, one frame in phase II (−1) is driven, so that pixels A & B are updated to the desired black and white state, respectively (in image E) and at this time point, both remaining pixels C & D are +10. This is followed by driving 10 frames in phase I (+10), leading pixels C & D to the desired white state.

The "corresponding appearance" row shows the corresponding appearance on the display at each time point. For example, in the fifth image from left, pixels A & B are white while pixels C and D are grey.

The last row indicates the time line.

Examples 7 & 8

In these two examples, the driving method of the present invention is carried out by the bi-polar waveforms of FIG. 5.

In Example 7, there is only one interrupting command and in Example 8, there are three interrupting commands.

Example 7

Figure 13:
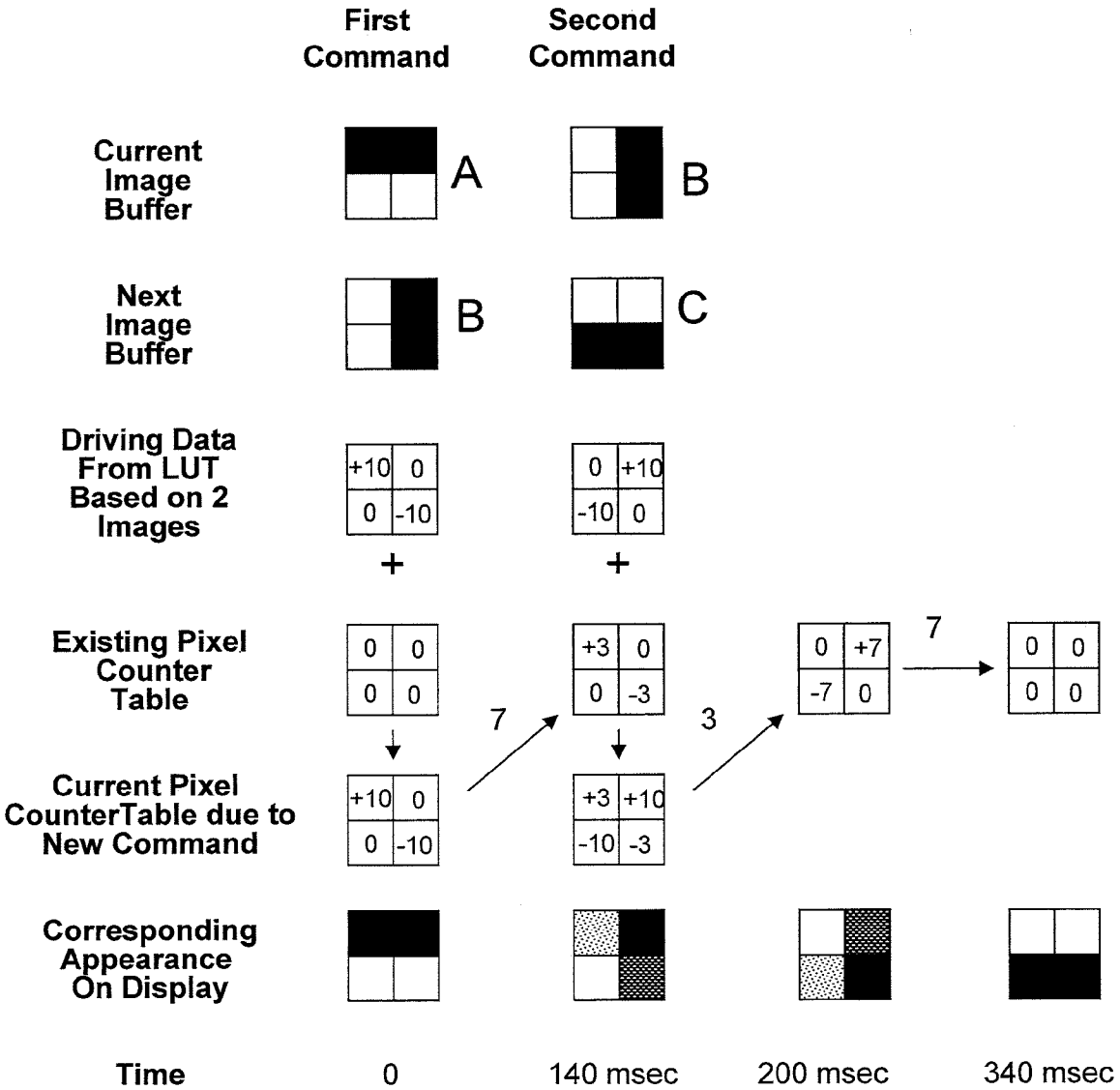
FIG. 13 illustrates a bi-polar driving example which has one interrupting command.

The example is summarized in FIG. 13.

The first command in this example wishes to update image A to image B. A display controller compares the two images and based on the comparison finds in a look-up table the driving data with pixels A-D being, +10, 0, 0 and −10, respectively.

Since this is the first command, at the time when it is received, the existing pixel counter table has all pixels A-D being 0.

The driving data are then added to the existing pixel counter table, resulting in a current pixel counter table, due to the new command, in which pixels A-D are +10, 0, 0 and −10, respectively.

Because the bi-polar waveforms are used, after seven frames are driven, the existing pixel counter table would have pixels A-D being +3, 0, 0 and −3, respectively. At this time point, a second command to update to image C is received.

The display controller then compares images B and C and based on the comparison finds in the look-up table the driving data with pixels A-D being 0, +10, −10 and 0, respectively.

The new driving data resulted from comparing images B and C are added to the existing pixel counter table, resulting in a current pixel counter table, due to the second command, having pixels A-D being +3, +10, −10 and −3, respectively.

The driving continues towards image C. At first, three frames are driven, so that pixels A and D are updated to the desired white and black state, respectively (in image C) and the remaining pixels B & C are +7 and −7, respectively. In the last step, seven frames are driven, leading pixels B & C to the desired white and black state, respectively.

The "corresponding appearance" row in FIG. 13 shows the corresponding appearance on display at each time point. For example, the third image from the left shows pixel A being in white, pixels B and C being in grey and pixel D being in black. The grey levels of the pixels in the images may vary, depending on how many frames have been driven.

The last row indicates the time line.

Example 8

Figure 14:
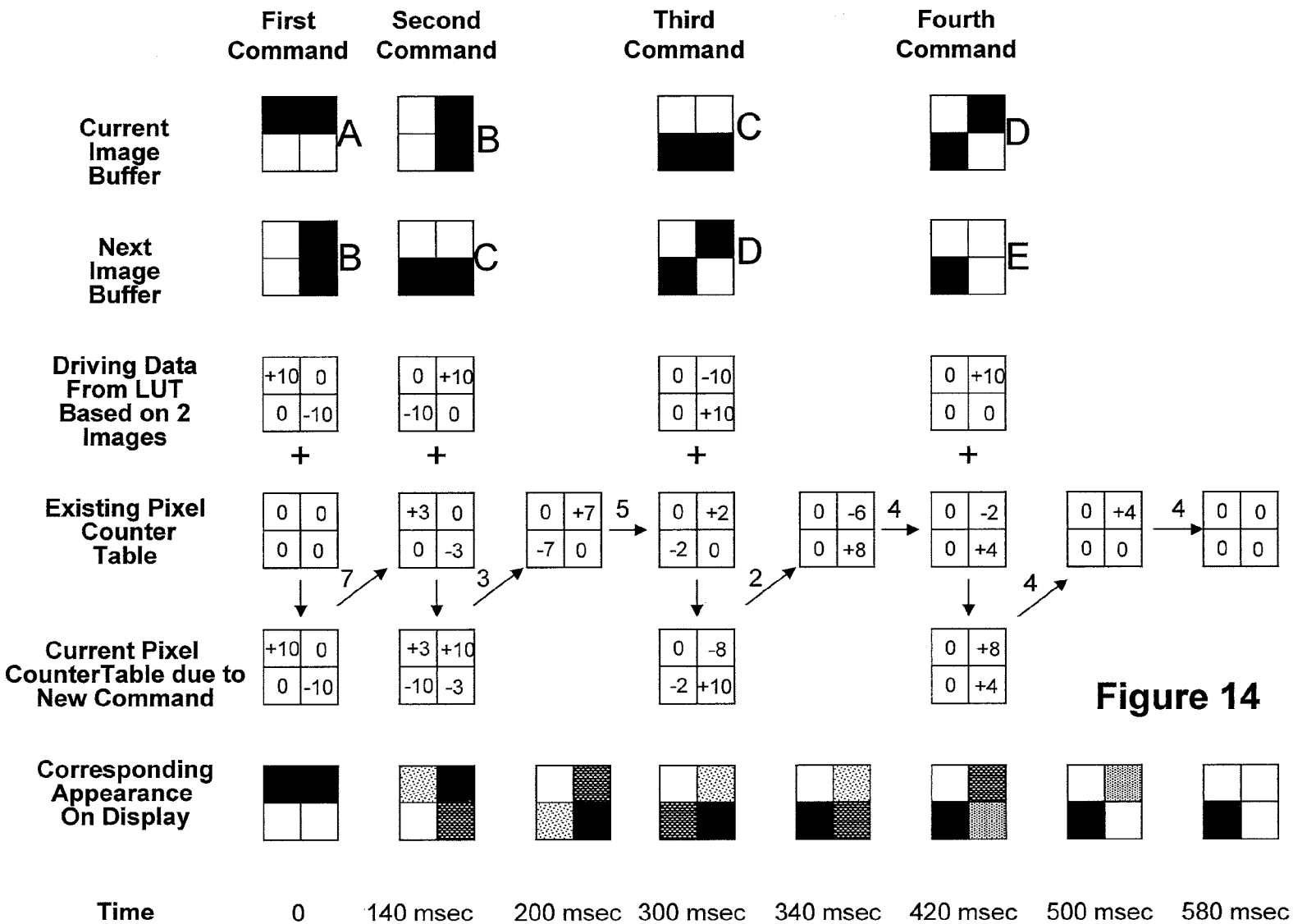
FIG. 14 illustrates a bi-polar driving example which has three interrupting commands.

In this example, there are three interrupting commands. The example is summarized in FIG. 14.

Initially, the first command wishes to update image A to image B, the second command wishes to update the image to image C and the third command wishes to update the image to image D.

The first two steps are identical to those in Example 7.

The driving continues towards image C. At first, three frames are driven, so that pixels A and D are updated to the desired white state and black state, respectively (in image C) and at this time point, the remaining pixels B & C are +7 and −7, respectively.

After 5 frames are driven, a third command is received to update to image D. The display controller then compares images C and D and based on the comparison finds in a look-up table the driving data with pixels A-D being 0, −10, 0 and +10, respectively. The existing pixel counter table at the time the third recommend is received has pixels A-D being 0, +2, −2 and 0, respectively.

The new driving data based on the comparison of image C and image D are added to the existing pixel counter table, resulting in a current pixel counter table, due to the third command, having pixels A-D being 0, −8, −2 and +10, respectively.

The driving continues towards image D. At first, two frames are driven, so that pixels A and C are updated to the desired white and black state, respectively (in image D) and at this time point, the remaining pixels B and D are at −6 and +8, respectively.

After 4 frames are driven, a fourth command is received to update to image E. The display controller then compares images D and E and based on the comparison finds in the look-up table the driving data with pixels A-D being 0, +10, 0 and 0, respectively. The existing pixel counter table at the time the fourth recommend is received has pixels A-D being 0, −2, 0 and +4, respectively.

The new driving data resulted from comparing image D and image E are added to the existing pixel counter table, resulting in a current pixel counter table, due to the fourth command, having pixels A-D being 0, +8, 0 and +4, respectively.

The driving continues towards image E. At first, four frames are driven, so that pixels A, C and D are updated to the desired white, black and white state, respectively (in image E) and at this time point, the remaining pixel B is at +4. Finally 4 frames are driven, leading pixel B to its desired color state, white.

The "corresponding appearance" row shows the corresponding appearance on the display at each time point. For example, in the fifth image from left, pixels A & C are white and black respectively while pixels B and D are grey although with different grey levels.

The last row indicates the time line.

Examples 9 & 10

These two examples demonstrate how the driving method of the present invention may also update images in grayscale. For ease of illustration, it is assumed in these two examples that there are only two grey states, G1 and G2.

FIG. 15 summarizes how a particular color state is driven to another color state. For example, a voltage of −V must be applied for 7 frames in order to drive a white pixel to a G1 color state or a voltage of +V must be applied for 4 frames in order to drive a G1 pixel to the G2 color state.

Figure 16:
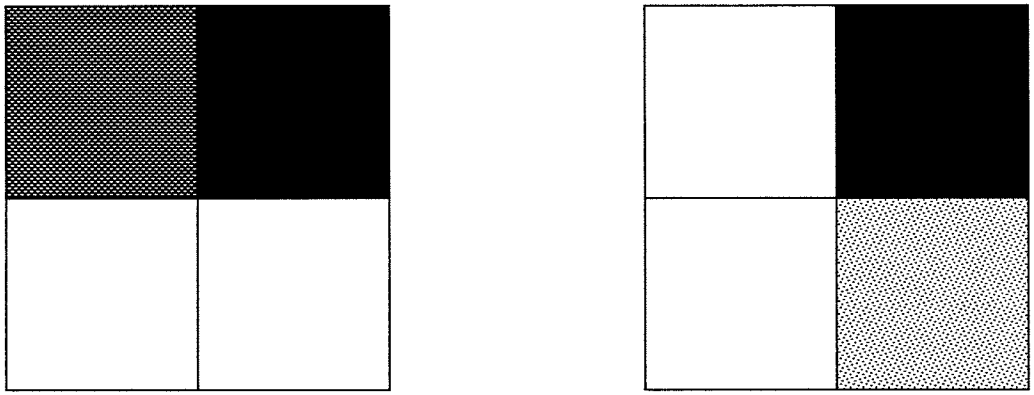
FIG. 16 illustrates a pixel counter table for a 4-pixel image being updated from current image to next image, with grey levels.

FIG. 16 shows a pixel counter table for driving the current image to the next image, both with G1 and G2 color state. The pixel counter table is generated based on waveform data in FIG. 15.

Example 9

Figure 17:
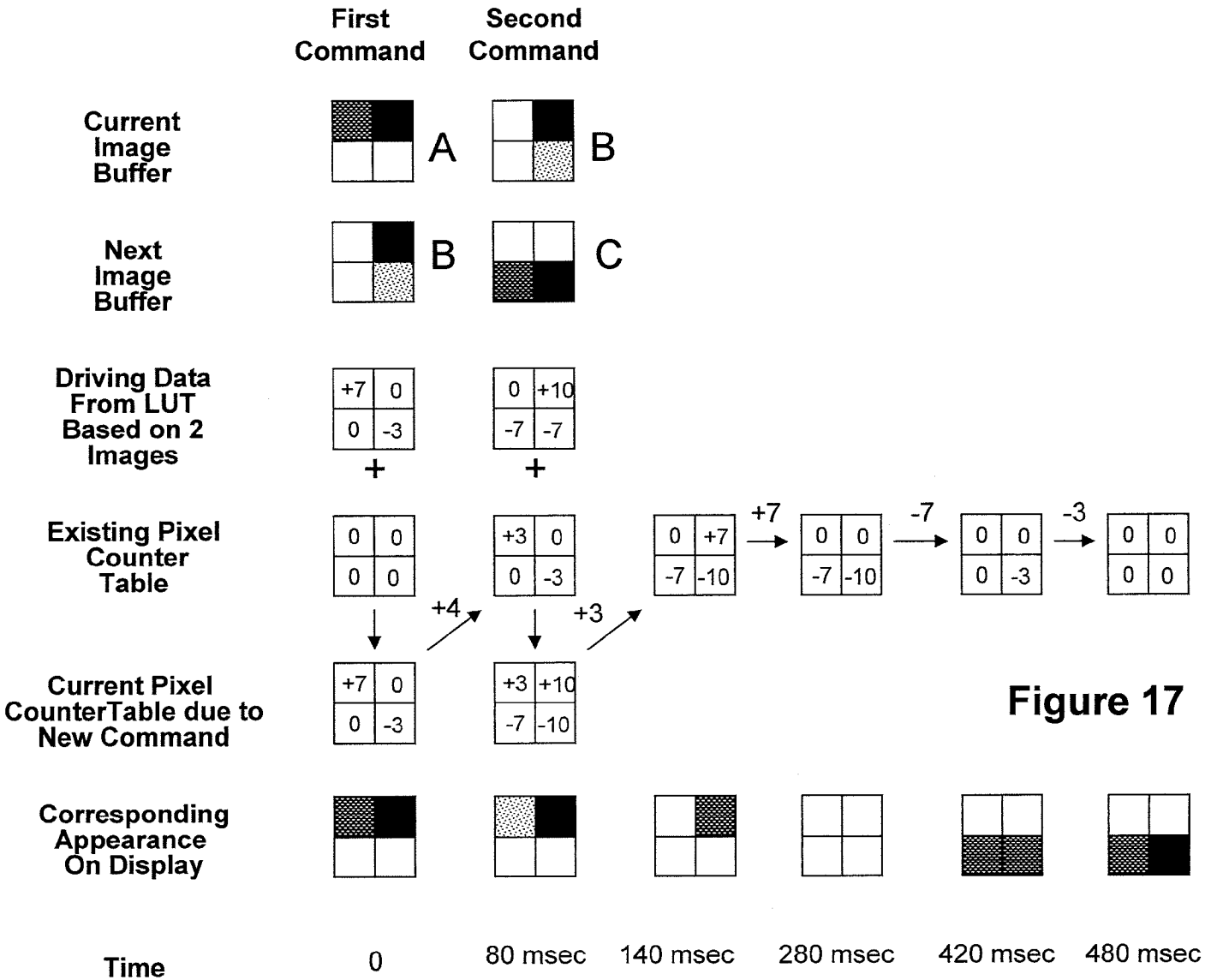
FIG. 17 illustrates a mono-polar grey scale driving example which has one interrupting command.

This example demonstrates the driving method utilizing mono-polar waveforms and the driving sequence is summarized in FIG. 17.

The first command in this example wishes to update image A to image B. A display controller compares the two images and based on the comparison finds in a look-up table such as FIG. 15 the driving data with pixels A-D being, +7, 0, 0 and −3, respectively.

Since this is the first command, at the time when it is received, the existing pixel counter table has all pixels A-D being 0.

The driving data are then added to the existing pixel counter table, resulting in a current pixel counter table, due to the new command, in which pixels A-D are +7, 0, 0 and −3, respectively.

In this example, after 4 frames in phase I (+4) are driven, a second command is received to update to image C. The display controller then compares images B and C and based on the comparison finds in the look-up table the driving data with pixels A-D being 0, +10, −7 and −7, respectively.

Since 4 frames in phase I (+4) have been driven, the existing pixel counter table at the time the second recommend is received has pixels A-D being +3, 0, 0 and −3, respectively.

The new driving data are added to the existing pixel counter table, resulting in a current pixel counter table, due to the second command, having pixels A-D being +3, +10, −7 and −10, respectively.

The driving continues towards image C. At first, three frames in phase I (+3) are driven, so that pixel A is updated to the desired white state (in image C) and at this time point, the remaining pixels B-D are +7, −7 and −10, respectively. This is followed by seven frames in phase I (+7) being driven, leading pixel B to the desired white state (in image C) and the remaining pixels C and D being −7 and −10, respectively.

In the next step, seven frames in phase II (−7) are driven, leading pixel C to the desired G2 state and pixel D at −3.

In the last step, three frames in phase II (−3) are driven, leading pixel D to the desired black state (in image C).

The "corresponding appearance" row in FIG. 17 shows the corresponding appearance on display at each time point. For example, the third image from the left shows pixels A, C and D being in the white state while pixel B being in a grey state. It is noted that some of the grey pixels are in neither G1 nor G2 state, and the grey levels depend on how many frames have been driven to arrive at a particular pixel color state.

The last row indicates the time line.

Example 10

Figure 18:
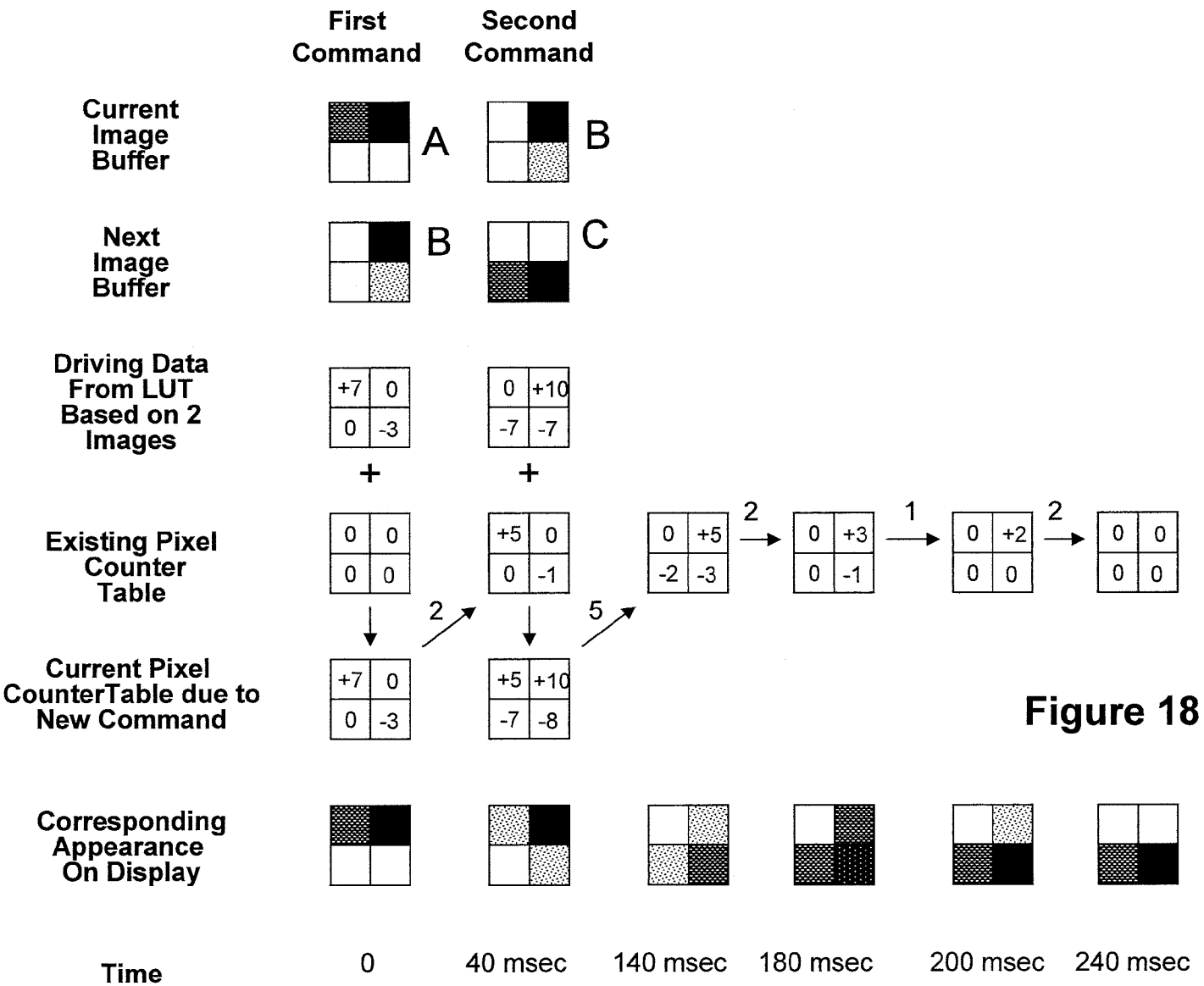
FIG. 18 illustrates a bi-polar grey scale driving example which has one interrupting command.

This example demonstrates the driving method utilizing bi-polar waveforms and the driving sequence is summarized in FIG. 18.

The first command in this example wishes to update image A to image B. A display controller compares the two images and based on the comparison finds in a look-up table such as the one in FIG. 15 the driving data with pixels A-D being, +7, 0, 0 and −3, respectively.

The driving data are then added to the existing pixel counter table, resulting in a current pixel counter table, due to the new command, in which pixels A-D are +7, 0, 0 and −3, respectively.

In this example, after 2 frames are driven, a second command is received to update to image C. The display controller then compares images B and C and based on the comparison finds in the look up table the driving data with pixels A-D being 0, +10, −7 and −7, respectively.

Since 2 frames have been driven, the existing pixel counter table at the time the second recommend is received has pixels A-D being +5, 0, 0 and −1, respectively.

The new driving data are added to the existing pixel counter table, resulting in a current pixel counter table, due to the second command, having pixels A-D being +5, +10, −7 and −8, respectively.

The driving continues towards image C. At first, five frames (5) are driven, so that pixel A is updated to the desired white state (in image C) and at this time point, the remaining pixels B-D are +5, −2 and −3, respectively. This is followed by two frames (2) being driven, leading pixel C to the desired G2 state (in image C) and the remaining pixels B and D being +3 and −1, respectively.

In the next step, one frame (1) is driven, leading pixel D to the desired black state.

In the last step, two frames (2) are driven, leading pixel B to the desired white state (in image C).

The "corresponding appearance" row in FIG. 18 shows the corresponding appearance on display at each time point. For example, the third image from the left shows pixel A being in the white state while pixels B-D being in grey states. It is noted that some of the grey pixels are in neither G1 nor G2 state, and the grey levels depend on how many frames have been driven to arrive at a particular pixel color state.

The last row indicates the time line.

Although the foregoing disclosure has been described in some detail for purposes of clarity of understanding, it will be apparent to a person having ordinary skill in that art that certain changes and modifications may be practiced within the scope of the appended claims. It should be noted that there are many alternative ways of implementing both the method and system of the present invention. Accordingly, the present embodiments are to be considered as exemplary and not restrictive, and the inventive features are not to be limited to the details given herein, but may be modified within the scope and equivalents of the appended claims.

What is claimed is:

1. A driving method for a display device comprising a plurality of pixels for updating a current image being displayed on the display device to a next image, wherein the method comprises:

a) comparing the two images to identify current color state of each pixel in the current image and next color state of the pixel in the next image;

b) determining driving data for the pixels of the display device wherein the driving data for each pixel are expressed in number of frames required for a positive pulse or a negative pulse to drive the pixel from its current color state to its next color state;

c) determining existing driving data for the pixels of the display device in a pixel counter table; and d) replacing the existing driving data of (c) with the sum of the driving data of (b) and the driving data of (c), in the pixel counter table; and e) displaying the next image on the display device by driving the pixels of the display device towards their respective next color states until the driving data reach 0 for all the pixels in the pixel counter table.

2. The driving method of claim 1 wherein pixels of a first color are driven to a second color in a first phase and pixels of the second color are driven to the first color in a second phase.

3. The driving method of claim 2 wherein a driving sequence comprises one or more of the first phases and one or more of the second phases.

4. The driving method of claim 3 wherein the order in which the first phase and the second phase are carried out depends on timing of an interrupting command.

5. The driving method of claim 4 wherein after receiving the interrupting command, the first phase is completed before the second phase.

6. The driving method of claim 4 wherein after receiving the interrupting command, the second phase is completed before the first phase.

7. The driving method of claim 4 wherein immediately before and after the interrupting command, the driving is carried out in the same phase.

8. The driving method of claim 3 wherein the first phase and the second phase are carried out in an interleaving manner.

9. The driving method of claim 1 wherein driving pixels of a first color to a second color and driving pixels of the second color to the first color take place in the same phase.

10. The driving method of claim 1 in step (e), pixels having driving data expressed in number of frames for a positive pulse are driven to 0 before pixels having driving data expressed in number of frames for a negative pulse are driven to 0.

11. The driving method of claim 1 in step (e), pixels having driving data expressed in number of frames for a positive pulse are driven to 0 before initiating driving pixels having driving data expressed in number of frames for a negative pulse.

12. The driving method of claim 1 in step (e), pixels having driving data expressed in number of frames for a negative pulse are driven to 0 before pixels having driving data expressed in number of frames for a positive pulse are driven to 0.

13. The driving method of claim 1 in step (e), pixels having driving data expressed in number of frames for a negative pulse are driven to 0 before initiating driving pixels having driving data expressed in number of frames for a positive pulse.

14. The driving method of claim 1 in step (e), pixels having driving data expressed in number of frames for a positive pulse and pixels having driving data expressed in number of frames for a negative pulse are driven at the same time.

* * * * *